US008930030B2

(12) United States Patent
Bester et al.

(10) Patent No.: US 8,930,030 B2
(45) Date of Patent: Jan. 6, 2015

(54) METHOD AND SYSTEM FOR IMPROVING ENERGY EFFICIENCY IN AN HVAC SYSTEM

(75) Inventors: Colin Bester, Dripping Springs, TX (US); Robert Bartmess, Austin, TX (US)

(73) Assignee: Siemens Industry, Inc., Alpharetta, GA (US)

( * ) Notice: Subject to any disclaimer, the term of this patent is extended or adjusted under 35 U.S.C. 154(b) by 466 days.

(21) Appl. No.: 13/249,291

(22) Filed: Sep. 30, 2011

(65) Prior Publication Data

US 2013/0085613 A1 Apr. 4, 2013

(51) Int. Cl.

| | |
|---|---|
| ***G05B 21/00*** | (2006.01) |
| ***G01M 1/38*** | (2006.01) |
| ***G05B 13/00*** | (2006.01) |
| ***G05B 15/00*** | (2006.01) |
| ***G05D 23/00*** | (2006.01) |
| ***F24F 3/00*** | (2006.01) |
| ***F25B 29/00*** | (2006.01) |
| ***F24F 7/06*** | (2006.01) |
| ***F24F 7/007*** | (2006.01) |
| ***F24F 11/02*** | (2006.01) |
| ***F24F 13/06*** | (2006.01) |
| ***F24F 11/00*** | (2006.01) |
| *F24F 13/10* | (2006.01) |

(52) U.S. Cl.

CPC ..... *F24F 11/0001* (2013.01); *F24F 11/006* (2013.01); *F24F 2011/0006* (2013.01); *F24F 2011/0064* (2013.01)

USPC ..... 700/278; 700/277; 165/217; 165/250; 165/253; 454/229; 454/236; 454/258; 454/333

(58) Field of Classification Search

CPC ..... F24F 11/0001; F24F 11/0009; F24F 11/0012; F24F 11/0017; F24F 2011/0002; F24F 2011/0006; F24F 2011/0013; F24F 2011/0026; F24F 2011/0056; F24F 2011/0057; F24F 2011/0063; F24F 2011/0064; F24F 2011/0075; Y02B 30/542; Y02B 30/767; Y02B 30/78; G05D 23/1902; G05D 23/1917; G05D 23/1919; G05D 23/1932; G05B 15/02; G05B 19/042; G05B 22/25289; G05B 2219/2614

USPC ..... 700/275–278; 165/200, 201, 205, 165/212–215, 217, 222–225, 248–250, 165/253; 236/44 R, 44 C, 49.1, 49.3, 46 R, 236/46 C, 47; 454/228, 229, 236, 256, 258, 454/333

See application file for complete search history.

(56) References Cited

U.S. PATENT DOCUMENTS 4,142,574 A * 3/1979 Shavit ..... 165/215
4,182,180 A 1/1980 Mott (Continued)

FOREIGN PATENT DOCUMENTS

EP 2345855 A1 7/2011

OTHER PUBLICATIONS

PCT Search Report dated Mar. 7, 2013, for application No. PCT/US2012/057419.

*Primary Examiner* — Crystal J Barnes-Bullock

(57) ABSTRACT

A method performed by a zone controller for a zone of a building for improving energy efficiency in a heating, ventilation, and air conditioning (HVAC) system is provided. The method includes operating in a ventilation mode. A temperature of the zone and outside air conditions for the building are monitored. A determination is made regarding whether to switch from the ventilation mode to an economizing mode based on a first set point for the temperature of the zone and based on the outside air conditions. The first set point is determined based on a second set point for the temperature that is different from the first set point. A determination is made regarding whether to activate the HVAC system based on the second set point.

20 Claims, 4 Drawing Sheets

(56) References Cited

U.S. PATENT DOCUMENTS

| | | | | | |
|---|---|---|---|---|---|
| 4,353,409 | A | | 10/1982 | Saunders et al. | |
| 4,379,484 | A | | 4/1983 | Lom et al. | |
| 4,570,448 | A | | 2/1986 | Smith | |
| 4,987,952 | A | * | 1/1991 | Beal et al. | 165/225 |
| 5,042,265 | A | * | 8/1991 | Baldwin et al. | 62/127 |
| 5,279,609 | A | * | 1/1994 | Meckler | 236/49.3 |
| 5,394,934 | A | * | 3/1995 | Rein et al. | 165/200 |
| 5,915,473 | A | * | 6/1999 | Ganesh et al. | 165/222 |
| 6,491,094 | B2 | * | 12/2002 | Rayburn et al. | 165/250 |
| 6,514,138 | B2 | | 2/2003 | Estepp | |
| 6,622,926 | B1 | * | 9/2003 | Sartain et al. | 236/46 R |
| 6,790,136 | B2 | * | 9/2004 | Sharp et al. | 454/229 |
| 7,434,413 | B2 | | 10/2008 | Wruck | |
| 7,644,869 | B2 | * | 1/2010 | Hoglund et al. | 236/49.1 |
| 7,797,080 | B2 | | 9/2010 | Durham, III | |
| 7,854,389 | B2 | * | 12/2010 | Ahmed | 236/44 C |
| 7,857,689 | B2 | * | 12/2010 | Perry | 454/188 |
| 8,195,335 | B2 | * | 6/2012 | Kreft et al. | 700/276 |
| 8,457,796 | B2 | * | 6/2013 | Thind | 700/276 |
| 8,515,584 | B2 | * | 8/2013 | Miller et al. | 700/276 |
| 2005/0278071 | A1 | | 12/2005 | Durham, III | |
| 2006/0234621 | A1 | | 10/2006 | Desrochers et al. | |
| 2008/0179409 | A1 | | 7/2008 | Seem | |
| 2008/0182506 | A1 | * | 7/2008 | Jackson et al. | 454/354 |
| 2010/0057258 | A1 | | 3/2010 | Clanin | |
| 2010/0070088 | A1 | | 3/2010 | Josserand et al. | |
| 2010/0312396 | A1 | | 12/2010 | George | |
| 2011/0046790 | A1 | | 2/2011 | Miller et al. | |

* cited by examiner

METHOD AND SYSTEM FOR IMPROVING ENERGY EFFICIENCY IN AN HVAC SYSTEM

TECHNICAL FIELD

The present disclosure is directed, in general, to building systems and, more particularly, to a method and system for improving energy efficiency in a heating, ventilation, and air conditioning (HVAC) system.

BACKGROUND OF THE DISCLOSURE

Building automation systems encompass a wide variety of systems that aid in the monitoring and control of various aspects of building operation. Building automation systems include security systems, fire safety systems, lighting systems, and HVAC systems. The elements of a building automation system are widely dispersed throughout a facility. For example, an HVAC system may include temperature sensors and ventilation damper controls, as well as other elements, that are located in virtually every area of a facility. These building automation systems typically have one or more centralized control stations from which system data may be monitored and various aspects of system operation may be controlled and/or monitored.

To allow for monitoring and control of the dispersed control system elements, building automation systems often employ multi-level communication networks to communicate operational and/or alarm information between operating elements, such as sensors and actuators, and the centralized control station. One example of a building automation system is the Site Controls Controller, available from Siemens Industry, Inc. Building Technologies Division of Buffalo Grove, Ill. ("Siemens"). In this system, several control stations connected via an Ethernet or another type of network may be distributed throughout one or more building locations, each having the ability to monitor and control system operation.

Maintaining indoor air quality in commercial buildings requires that significant outside (fresh) air be supplied according to building codes and industry standards. Most retail sites have HVAC systems set up statically to serve maximum occupancy levels. As buildings are rarely fully occupied, the HVAC system wastes energy heating, cooling, and dehumidifying this excess amount of outside air. In many applications, the HVAC fan is programmed to run 24/7, regardless of heating or cooling need, or occupancy levels, further wasting energy.

SUMMARY OF THE DISCLOSURE

This disclosure describes a method and system for improving energy efficiency in a heating, ventilation, and air conditioning (HVAC) system.

In accordance with one embodiment of the disclosure, a method is performed by a zone controller for a zone of a building to improve energy efficiency in an HVAC system. The method includes operating in a ventilation mode. A temperature of the zone and outside air conditions for the building are monitored. A determination is made regarding whether to switch from the ventilation mode to an economizing mode based on a first set point for the temperature of the zone and based on the outside air conditions. The first set point is determined based on a second set point for the temperature that is different from the first set point. A determination is made regarding whether to activate the HVAC system based on the second set point.

In accordance with another embodiment of the disclosure, a zone controller for a zone of a building includes a memory and a processor. The memory is configured to store a subsystem application. The processor is coupled to the memory. Based on the subsystem application, the processor is configured to operate in one of a ventilation mode and an economizing mode. The processor is also configured to monitor a temperature of the zone and outside air conditions for the building. The processor is also configured to switch from the ventilation mode to the economizing mode based on a first set point for the temperature of the zone and based on the outside air conditions. The first set point is determined based on a second set point for the temperature that is different from the first set point. The processor is also configured to activate an HVAC system based on the second set point.

In accordance with yet another embodiment of the disclosure, a non-transitory computer-readable medium is provided. The computer-readable medium is encoded with executable instructions that, when executed, cause one or more data processing systems in a zone controller for a zone of a building to operate in one of a ventilation mode and an economizing mode, to monitor a temperature of the zone and outside air conditions for the building, to determine whether to switch from the ventilation mode to the economizing mode based on a first set point for the temperature of the zone and based on the outside air conditions, and to activate an HVAC system based on a second set point for the temperature. The first set point is determined based on the second set point and is different from the second set point.

Other technical features may be readily apparent to one skilled in the art from the following figures, descriptions, and claims.

Before undertaking the DETAILED DESCRIPTION below, it may be advantageous to set forth definitions of certain words or phrases used throughout this patent document: the terms "include" and "comprise," as well as derivatives thereof, mean inclusion without limitation; the term "or" is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, whether such a device is implemented in hardware, firmware, software or some combination of at least two of the same. It should be noted that the functionality associated with any particular controller may be centralized or distributed, whether locally or remotely. Definitions for certain words and phrases are provided throughout this patent document, and those of ordinary skill in the art will understand that such definitions apply in many, if not most, instances to prior as well as future uses of such defined words and phrases. While some terms may include a wide variety of embodiments, the appended claims may expressly limit these terms to specific embodiments.

BRIEF DESCRIPTION OF THE DRAWINGS

For a more complete understanding of the present disclosure, and the advantages thereof, reference is now made to the following descriptions taken in conjunction with the accompanying drawings, wherein like numbers designate like objects, and in which.

DETAILED DESCRIPTION

Figure 1:
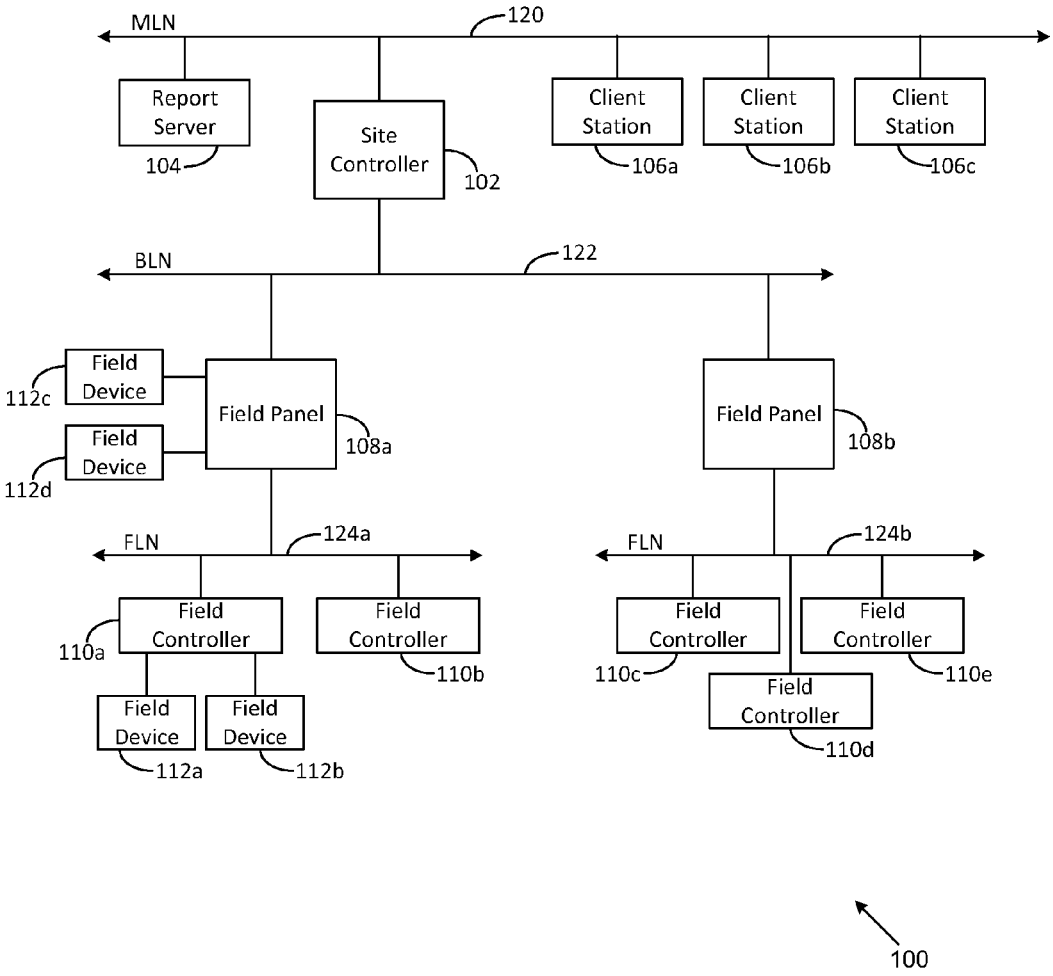
FIG. 1 illustrates a block diagram of a building automation system in which the energy efficiency of a heating, ventilation, and air conditioning (HVAC) system may be improved in accordance with the present disclosure.

FIGS. 1 through 5, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged device or system.

Demand Control Ventilation (DCV) systems vary the amount of outside air supplied into a commercial building based on occupancy. Older heating, ventilation and air conditioning (HVAC) systems require an expensive damper retrofit, or total unit replacement in order to support conventional DCV. Recently, intelligent DCV (IDCV) has been developed to allow both new and legacy HVAC systems in real-time to adjust the amount of outside air based on actual occupancy levels, to improve air quality in humid climates, and to eliminate wasted fan energy. This IDCV provides significant annual HVAC energy savings. In addition, IDCV can be installed at a far lower cost than retrofit or unit replacement.

ANSI/ASHRAE 62.1-2004 provides the source requirements for DCV widely adopted by government agencies. Without an actual occupancy measurement, standard compliance is only assured when the outside air mix is preset for 100% occupancy. In the case of unoccupied retail space, such as after store hours, the requirement for outside air is 0%. Energy management systems, therefore, put all RTU fans in AUTO mode during unoccupied hours so that the fans run only if calling for heating or cooling. During occupied hours, however, existing DCV solutions may provide a measure of occupancy by measuring carbon dioxide ($CO_2$) or other contaminant levels at each rooftop unit (RTU). This allows RTUs equipped with an economizer (or an add-on motorized damper) to close their outside damper when outside air is not needed due to low contaminant levels, yielding significant annual energy savings as compared to systems operating based on 100% occupancy.

However, there are several operational limitations with conventional DCV systems, such as applicability only to newer RTUs equipped with economizers or added motorized dampers, failing dampers that may go unnoticed for months, inefficiencies related to fans running non-stop during occupied hours, and higher RTU maintenance costs. While still implementing DCV based on contaminant-level input, the IDCV option addresses these limitations, while capturing additional cost savings and reducing operational risks. With IDCV, contaminant levels are monitored globally and a sophisticated control algorithm is applied to the RTUs in a building, including older units built without an economizer or motorized outside air damper. For RTUs without an economizer, fans are switched between AUTO and ON modes to control the contaminant level in compliance with the ASHRAE standards. The RTU fans are controlled in a coordinated fashion to reduce peak loads, while still circulating air in the store to ensure customer and employee comfort. Therefore, IDCV provides numerous improvements as compared to conventional DCV. However, for facilities implementing either conventional DCV or IDCV, any additional improvement in energy efficiency may result in significant cost savings.

FIG. 1 illustrates a block diagram of a building automation system 100 in which the energy efficiency of an HVAC system may be improved in accordance with the present disclosure. The building automation system 100 is an environmental control system configured to control at least one of a plurality of environmental parameters within a building, such as temperature, humidity, lighting and/or the like. For example, for a particular embodiment, the building automation system 100 may comprise the Site Controls Controller building automation system that allows the setting and/or changing of various controls of the system. While a brief description of the building automation system 100 is provided below, it will be understood that the building automation system 100 described herein is only one example of a particular form or configuration for a building automation system and that the system 100 may be implemented in any other suitable manner without departing from the scope of this disclosure.

For the illustrated embodiment, the building automation system 100 comprises a site controller 102, a report server 104, a plurality of client stations 106*a-c*, a plurality of field panels 108*a-b*, a plurality of field controllers 110*a-e* and a plurality of field devices 112*a-d*. Although illustrated with three client stations 106, two field panels 108, five field controllers 110 and four field devices 112, it will be understood that the system 100 may comprise any suitable number of any of these components 106, 108, 110 and 112 based on the particular configuration for a particular building.

The site controller 102, which may comprise a computer or a general-purpose processor, is configured to provide overall control and monitoring of the building automation system 100. The site controller 102 may operate as a data server that is capable of exchanging data with various elements of the system 100. As such, the site controller 102 may allow access to system data by various applications that may be executed on the site controller 102 or other supervisory computers (not shown in FIG. 1).

For example, the site controller 102 may be capable of communicating with other supervisory computers, Internet gateways, or other gateways to other external devices, as well as to additional network managers (which in turn may connect to more subsystems via additional low-level data networks) by way of a management level network (MLN) 120. The site controller 102 may use the MLN 120 to exchange system data with other elements on the MLN 120, such as the report server 104 and one or more client stations 106. The report server 104 may be configured to generate reports regarding various aspects of the system 100. Each client station 106 may be configured to communicate with the system 100 to receive information from and/or provide modifications to the system 100 in any suitable manner. The MLN 120 may comprise an Ethernet or similar wired network and may employ TCP/IP, BACnet and/or other protocols that support high-speed data communications.

The site controller 102 may also be configured to accept modifications and/or other input from a user. This may be accomplished via a user interface of the site controller 102 or any other user interface that may be configured to communicate with the site controller 102 through any suitable network or connection. The user interface may include a keyboard, touchscreen, mouse, or other interface components. The site controller 102 is configured to, among other things, affect or change operational data of the field panels 108, as well as other components of the system 100. The site controller 102 may use a building level network (BLN) 122 to exchange system data with other elements on the BLN 122, such as the field panels 108.

Each field panel 108 may comprise a general-purpose processor and is configured to use the data and/or instructions from the site controller 102 to provide control of its one or more corresponding field controllers 110. While the site controller 102 is generally used to make modifications to one or more of the various components of the building automation system 100, a field panel 108 may also be able to provide certain modifications to one or more parameters of the system 100. Each field panel 108 may use a field level network (FLN) 124 to exchange system data with other elements on the FLN 124, such as a subset of the field controllers 110 coupled to the field panel 108.

Each field controller 110 may comprise a general-purpose processor and may correspond to one of a plurality of localized, standard building automation subsystems, such as building space temperature control subsystems, lighting control subsystems, or the like. For a particular embodiment, the field controllers 110 may comprise the model TEC (Terminal Equipment Controller) available from Siemens. However, it will be understood that the field controllers 110 may comprise any other suitable type of controllers without departing from the scope of the present invention.

To carry out control of its corresponding subsystem, each field controller 110 may be coupled to one or more field devices 112. Each field controller 110 is configured to use the data and/or instructions from its corresponding field panel 108 to provide control of its one or more corresponding field devices 112. For some embodiments, some of the field controllers 110 may control their subsystems based on sensed conditions and desired set point conditions. For these embodiments, these field controllers 110 may be configured to control the operation of one or more field devices 112 to attempt to bring the sensed condition to the desired set point condition. It is noted that in the system 100, information from the field devices 112 may be shared between the field controllers 110, the field panels 108, the site controller 102 and/or any other elements on or connected to the system 100.

In order to facilitate the sharing of information between subsystems, groups of subsystems may be organized into an FLN 124. For example, the subsystems corresponding to the field controllers 110*a* and 110*b* may be coupled to the field panel 108*a* to form the FLN 124*a*. The FLNs 124 may each comprise a low-level data network that may employ any suitable proprietary or open protocol.

Each field device 112 may be configured to measure, monitor and/or control various parameters of the building automation system 100. Examples of field devices 112 include lights, thermostats, temperature sensors, fans, damper actuators, heaters, chillers, alarms, HVAC devices, and numerous other types of field devices. The field devices 112 may be capable of receiving control signals from and/or sending signals to the field controllers 110, the field panels 108 and/or the site controller 102 of the building automation system 100. Accordingly, the building automation system 100 is able to control various aspects of building operation by controlling and monitoring the field devices 112.

As illustrated in FIG. 1, any of the field panels 108, such as the field panel 108*a*, may be directly coupled to one or more field devices 112, such as the field devices 112*c* and 112*d*. For this type of embodiment, the field panel 108*a* may be configured to provide direct control of the field devices 112*c* and 112*d* instead of control via one of the field controllers 110*a* or 110*b*. Therefore, for this embodiment, the functions of a field controller 110 for one or more particular subsystems may be provided by a field panel 108 without the need for a field controller 110.

Figure 2:
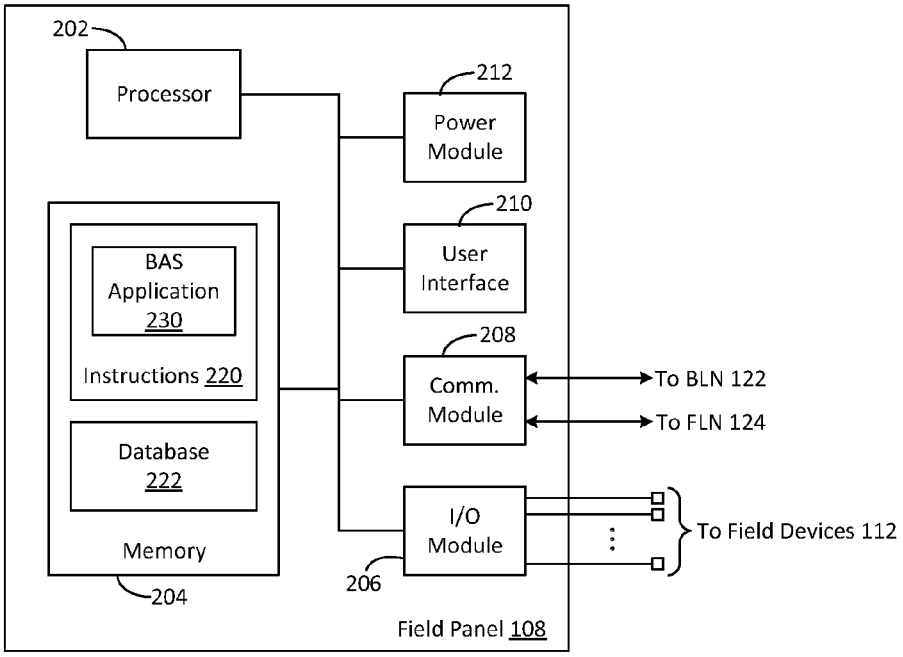
FIG. 2 illustrates details of one of the field panels of FIG. 1 in accordance with the present disclosure.

FIG. 2 illustrates details of one of the field panels 108 in accordance with the present disclosure. For this particular embodiment, the field panel 108 comprises a processor 202, a memory 204, an input/output (I/O) module 206, a communication module 208, a user interface 210 and a power module 212. The memory 204 comprises any suitable data store capable of storing data, such as instructions 220 and a database 222. It will be understood that the field panel 108 may be implemented in any other suitable manner without departing from the scope of this disclosure.

The processor 202 is configured to operate the field panel 108. Thus, the processor 202 may be coupled to the other components 204, 206, 208, 210 and 212 of the field panel 108. The processor 202 may be configured to execute program instructions or programming software or firmware stored in the instructions 220 of the memory 204, such as building automation system (BAS) application software 230. In addition to storing the instructions 220, the memory 204 may also store other data for use by the system 100 in the database 222, such as various records and configuration files, graphical views and/or other information.

Execution of the BAS application 230 by the processor 202 may result in control signals being sent to any field devices 112 that may be coupled to the field panel 108 via the I/O module 206 of the field panel 108. Execution of the BAS application 230 may also result in the processor 202 receiving status signals and/or other data signals from field devices 112 coupled to the field panel 108 and storage of associated data in the memory 204. In one embodiment, the BAS application 230 may be provided by the Site Controls Controller software commercially available from Siemens Industry, Inc. However, it will be understood that the BAS application 230 may comprise any other suitable BAS control software.

The I/O module 206 may comprise one or more input/output circuits that are configured to communicate directly with field devices 112. Thus, for some embodiments, the I/O module 206 comprises analog input circuitry for receiving analog signals and analog output circuitry for providing analog signals.

The communication module 208 is configured to provide communication with the site controller 102, other field panels 108 and other components on the BLN 122. The communication module 208 is also configured to provide communication to the field controllers 110, as well as other components on the FLN 124 that is associated with the field panel 108. Thus, the communication module 208 may comprise a first port that may be coupled to the BLN 122 and a second port that may be coupled to the FLN 124. Each of the ports may include an RS-485 standard port circuit or other suitable port circuitry.

The field panel 108 may be capable of being accessed locally via the interactive user interface 210. A user may control the collection of data from field devices 112 through the user interface 210. The user interface 210 of the field panel 108 may include devices that display data and receive input data. These devices may be permanently affixed to the field panel 108 or portable and moveable. For some embodiments, the user interface 210 may comprise an LCD-type screen or the like and a keypad. The user interface 210 may be configured to both alter and show information regarding the field panel 108, such as status information and/or other data pertaining to the operation of, function of and/or modifications to the field panel 108.

The power module 212 may be configured to supply power to the components of the field panel 108. The power module 212 may operate on standard 120 volt AC electricity, other AC voltages or DC power supplied by a battery or batteries.

Figure 3:
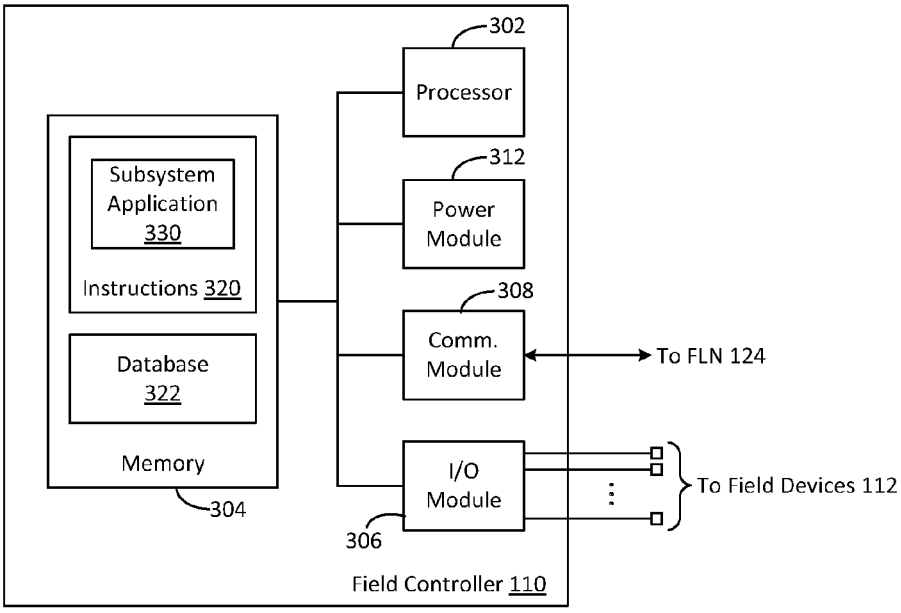
FIG. 3 illustrates details of one of the field controllers of FIG. 1 in accordance with the present disclosure.

FIG. 3 illustrates details of one of the field controllers 110 in accordance with the present disclosure. For this particular embodiment, the field controller 110 comprises a processor 302, a memory 304, an input/output (I/O) module 306, a communication module 308 and a power module 312. For some embodiments, the field controller 110 may also comprise a user interface (not shown in FIG. 3) that is configured to alter and/or show information regarding the field controller 110. The memory 304 comprises any suitable data store capable of storing data, such as instructions 320 and a database 322. It will be understood that the field controller 110 may be implemented in any other suitable manner without departing from the scope of this disclosure. For some embodiments, the field controller 110 may be positioned in, or in close proximity to, a room of the building where temperature or another environmental parameter associated with the subsystem may be controlled with the field controller 110.

The processor 302 is configured to operate the field controller 110. Thus, the processor 302 may be coupled to the other components 304, 306, 308 and 312 of the field controller 110. The processor 302 may be configured to execute program instructions or programming software or firmware stored in the instructions 320 of the memory 304, such as subsystem application software 330. For a particular example, the subsystem application 330 may comprise a temperature control application that is configured to control and process data from all components of a temperature control subsystem, such as a temperature sensor, a damper actuator, fans, and various other field devices. In addition to storing the instructions 320, the memory 304 may also store other data for use by the subsystem in the database 322, such as various configuration files and/or other information.

Execution of the subsystem application 330 by the processor 302 may result in control signals being sent to any field devices 112 that may be coupled to the field controller 110 via the I/O module 306 of the field controller 110. Execution of the subsystem application 330 may also result in the processor 302 receiving status signals and/or other data signals from field devices 112 coupled to the field controller 110 and storage of associated data in the memory 304.

The I/O module 306 may comprise one or more input/output circuits that are configured to communicate directly with field devices 112. Thus, for some embodiments, the I/O module 306 comprises analog input circuitry for receiving analog signals and analog output circuitry for providing analog signals.

The communication module 308 is configured to provide communication with the field panel 108 corresponding to the field controller 110 and other components on the FLN 124, such as other field controllers 110. Thus, the communication module 308 may comprise a port that may be coupled to the FLN 124. The port may include an RS-485 standard port circuit or other suitable port circuitry.

The power module 312 may be configured to supply power to the components of the field controller 110. The power module 312 may operate on standard 120 volt AC electricity, other AC voltages, or DC power supplied by a battery or batteries.

Figure 4:
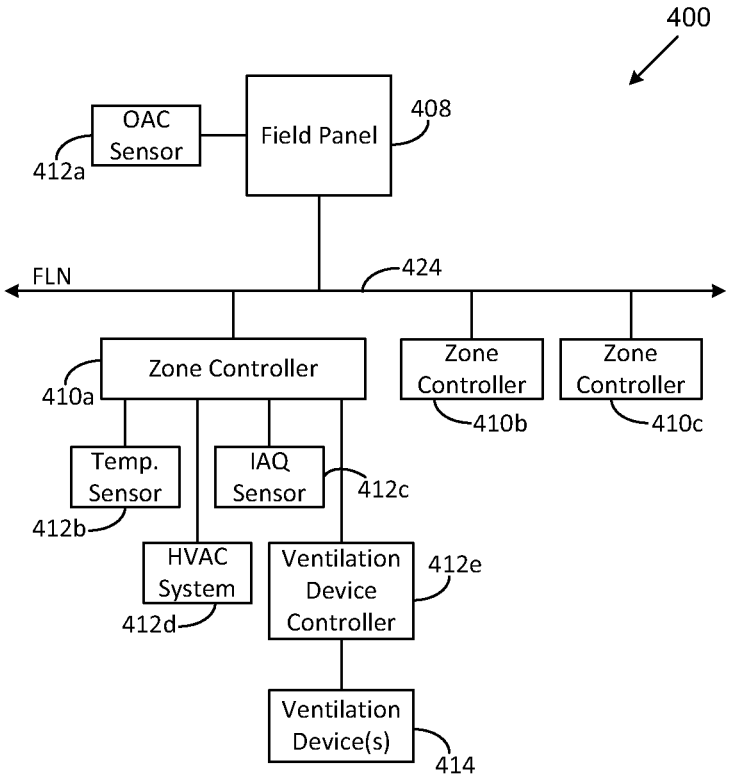
FIG. 4 illustrates a portion of a building automation system, such as the system of FIG. 1, that is capable of improving the energy efficiency of an HVAC system in accordance with the present disclosure.

FIG. 4 illustrates at least a portion of a building automation system 400 that is capable of improving the energy efficiency of an HVAC system in accordance with the present disclosure. For the particular embodiment illustrated in FIG. 4, the system 400 comprises a field panel 408, three zone controllers 410*a-c*, and five field devices 412*a-e*. However, it will be understood that the system 400 may comprise any suitable number of these components without departing from the scope of this disclosure.

The illustrated system 400 may correspond to the system 100 of FIG. 1; however, it will be understood that the system 400 may be implemented in any suitable manner and/or configuration without departing from the scope of this disclosure. Thus, for example, the field panel 408 may correspond to the field panel 108, each of the zone controllers 410 may correspond to a field controller 110, and each of the components 412*a-e* may correspond to a field device 112 as described above in connection with FIGS. 1-3. In addition, these components may communicate via a field level network (FLN) 424, which may correspond to the FLN 124 of the system 100 of FIG. 1.

For some embodiments, a building or other area in which an HVAC system is implemented may comprise a single zone. For these embodiments, the system 400 may comprise a single zone controller 410, such as the zone controller 410*a*. However, for other embodiments, such as in a relatively large building, the building may comprise two or more zones. For example, in a retail store, the public area may comprise one zone, while a back storage area may comprise another zone. For the illustrated example, the system 400 comprises three such zones, each of which has a corresponding zone controller 410*a-c*.

The embodiment of FIG. 4 comprises five field devices 412*a-e*. As described below, these field devices 412 comprise an outside air conditions (OAC) sensor 412*a*, a temperature sensor 412*b*, an indoor air quality (IAQ) sensor 412*c*, an HVAC system 412*d*, and a ventilation device controller 412*e*. Although the illustrated embodiment shows only the zone controller 410*a* coupled to a temperature sensor 412*b*, an IAQ sensor 412*c*, an HVAC system 412*d* and a ventilation device controller 412*e*, it will be understood that each of the zone controllers 410*b* and 410*c* may also be coupled to similar field devices 412*b-e* for its associated zone.

For some embodiments, the field panel 408 may be coupled to the OAC sensor 412*a*. The OAC sensor 412*a* is configured to sense parameters, such as temperature, humidity and/or the like, associated with the air outside the building. The OAC sensor 412*a* is also configured to generate an OAC signal based on the outside air conditions and send the OAC signal to the field panel 408. For other embodiments, the OAC sensor 412*a* may be coupled to one of the zone controllers 410 or other component of the system 400, such as a site controller, and may be configured to send the OAC signal to that other component. For some embodiments, such as those that provide conventional demand control ventilation, the OAC sensor 412*a* may be coupled to the zone controller 410*a* and the system 400 may be provided without the FLN 424. For these embodiments, the zone controllers 410 may be independent from, and incapable of communicating with, the other zone controllers 410.

The temperature sensor 412*b* is configured to sense the temperature of the zone associated with the zone controller 410*a* and to report the sensed temperature to the zone controller 410*a*. The IAQ sensor 412*c* is configured to sense the level of $CO_2$ and/or other contaminants in the zone and to report the sensed contaminant level to the zone controller 410*a*. For some embodiments, the IAQ sensor 412*c* may be configured to sense the level of contaminants in the entire building. For these embodiments, the system 400 may comprise a single IAQ sensor 412*c* coupled to a single zone controller 410*a*, a field panel 408 or other suitable component, instead of an IAQ sensor 412*c* coupled to each zone controller 410*a-c*. The HVAC system 412*d* may comprise a rooftop HVAC unit, an air handler unit, or any other suitable type of unit capable of providing heating, ventilation, and cooling for the building. In addition, it will be understood that the system 400 may comprise any combination of various types of HVAC systems. For example, the HVAC system 412*d* may comprise a rooftop HVAC unit, while the zone controller 410*b* may be coupled to an air handler unit and the zone controller 410*c* may be coupled to yet another type of HVAC system.

The ventilation device controller 412*e* is coupled to a ventilation device or devices 414 and is configured to control the operation of the ventilation device 414. For some embodiments that provide conventional demand control ventilation, the ventilation device 414 may comprise a damper on the HVAC system 412*d*, and the ventilation device controller 412*e* may comprise a damper actuator that is configured to open and close the damper. For these embodiments, the damper actuator may open or close the damper based on a ventilation signal from the zone controller 410*a*, as described in more detail below.

For other embodiments that provide intelligent demand control ventilation, the ventilation device 414 may comprise a plurality of fans capable of moving air through the zone of the building associated with the zone controller 410*a*, and the ventilation device controller 412*e* may comprise a fan controller that is configured to turn the fans on and off. For these embodiments, the fan controller may turn one or more of the fans on or off based on a ventilation signal from the zone controller 410*a*, as described in more detail below. For other embodiments, the zone controller 410*a* may be directly coupled to the ventilation device 414, and the ventilation device controller 412*e* may be omitted. For these embodiments, the zone controller 410*a* may be configured to provide the ventilation signal directly to the fans to turn the fans on and off. For still other embodiments that provide intelligent demand control ventilation, as described in more detail below, the ventilation device 414 may comprise both a damper on the HVAC system 412*d* and a plurality of fans.

The zone controller 410*a* may be installed in or near a room in which the HVAC system 412*d* is located, in a back office, or in any other suitable location in the building. The OAC sensor 412*a* may be installed outside the building. The temperature sensor 412*b* may be installed in the zone associated with the zone controller 410*a*. The IAQ sensor 412*c* may be installed in the zone associated with the zone controller 410*a* or, for embodiments in which only a single IAQ sensor is implemented in the building, in a central location in the building. The HVAC system 412*d* may be installed on the roof of the building, adjacent to the building, or in any other suitable location. The ventilation device controller 412*e* may be installed in the zone associated with the zone controller 410*a* and/or near the ventilation device 414. It will be understood that each of the components of the system 400 may be located in any suitable location without departing from the scope of the present disclosure.

The zone controller 410*a* is configured to monitor the temperature of its zone based on a temperature signal from the temperature sensor 412*b* and to monitor the contaminant-level of the zone based on an IAQ signal from the IAQ sensor 412*c*. The zone controller 410*a* is also configured to activate or deactivate the HVAC system 412*d* to provide heating or cooling based on the temperature signal. The zone controller 410*a* is also configured to switch the zone between a ventilation mode and an economizing mode based on the temperature signal provided by the temperature sensor 412*b* and the OAC signal provided by the OAC sensor 412*a*, which may be provided via the field panel 408 for some embodiments.

While operating in the ventilation mode, the zone controller 410*a* is configured to control the ventilation device 414, either directly or indirectly through the ventilation device controller 412*e*, to allow outside air into the building or prevent outside air from entering the building based on the IAQ signal. In addition, in the ventilation mode, the zone controller 410*a* is configured to monitor the temperature to determine whether or not to activate or deactivate the HVAC system 412*d* and to monitor the temperature and outside air conditions to determine whether or not to switch into the economizing mode.

For some embodiments in which conventional demand control ventilation is provided, the zone controller 410*a* is configured to control outside air coming into the building by sending a ventilation signal to the ventilation device controller 412*e*, which comprises a damper actuator, in order to cause the ventilation device controller 412*e* to open or close the ventilation device 414, which comprises a damper on the HVAC system 412*d*.

For some embodiments in which intelligent demand control ventilation is provided, the zone controller 410*a* may be configured to control outside air coming into the building by sending a ventilation signal to the ventilation device controller 412*e*, which comprises a fan controller, in order to cause the ventilation device controller 412*e* to turn on or off at least a subset of the ventilation devices 414, which comprise fans. For other embodiments, the zone controller 410*a* may be configured to control outside air coming into the building by sending a ventilation signal directly to the ventilation devices 414, which comprise fans, to turn on or off at least a subset of the fans. When in ventilation mode, the zone controller 410*a* may be configured to determine a number of fans to turn on or off based on the slope of the increase in the contaminant level. In addition, when less than all the fans are to be turned on, the zone or zones in which the fans will be turned on may be selected based on a cycling algorithm in order to minimize stale air in any one zone of the building.

For other embodiments in which intelligent demand control ventilation is provided, the ventilation device 414 comprises both a damper and a plurality of fans, and the zone controller 410*a* may be configured to control outside air coming into the building by sending a ventilation signal that opens or closes the damper and/or turns on or off at least a subset of the fans. Thus, for these embodiments, the zone controller 410*a* is configured to control both the damper and the fans in order to control the amount of outside air coming into the building. The zone controller 410*a* for these embodiments may open or close the damper, while turning on or off any suitable number of the fans at the same time, based on the criteria discussed above.

While operating in the economizing mode, the zone controller 410*a* is configured to control the ventilation device 414, either directly or indirectly through the ventilation device controller 412*e*, to allow outside air into the building based on the temperature and outside air conditions. Thus, the economizing mode allows the system 400 to take advantage of "free cooling" available through outside air that is cooler than the indoor air or "free heating" available through outside air that is warmer than the indoor air. As described above, the zone controller 410*a* may allow outside air into the building by sending a ventilation signal that causes a damper to be opened and/or turns on the fans. For some embodiments providing intelligent demand control ventilation, all the fans may be turned on in the economizing mode. In addition, in the economizing mode, the zone controller 410*a* is configured to monitor the temperature to determine whether or not to switch into the ventilation mode.

To determine when to switch from the ventilation mode to the economizing mode, the zone controller 410*a* is configured to monitor the temperature based on a first set point that is different from a second set point used to determine when to activate heating or cooling by the HVAC system 412*d*. When the outside air conditions are favorable and the temperature reaches the first set point, the zone controller 410*a* is configured to switch into the economizing mode. When the outside air conditions are not favorable and the temperature reaches the first set point, the zone controller 410*a* is configured to stay in the ventilation mode and monitor the temperature based on the second set point. When the temperature reaches the second set point, the zone controller 410*a* is configured to activate the HVAC system 412*d*.

For the following description, it is assumed that the system 400 is set up for cooling; however, it will be understood that the system 400 may operate in a similar manner for heating. The first set point may be a dynamically configurable set point that may be determined based on the value of the second set point. For some embodiments, the first set point may be a predetermined amount less than the second set point. For example, the first set point may be 0.2° less than the second set point. For a particular example, for a second (cooling) set point of 72°, the first (economizing) set point may be 71.8°.

For other embodiments, the first set point may be determined based on any suitable parameters of the system 400. For example, for a particular embodiment in which the HVAC system 412*d* comprises a fixed-damper rooftop HVAC unit, the first set point may be determined based on a percentage of outside air allowed into the building by the HVAC system 412*d*. Some fixed-damper rooftop HVAC units may allow in 10% outside air, 20% outside air, 30% outside air or any other suitable percentage. Thus, for these types of systems 400 in which the HVAC system 412*d* allows in 30% outside air, the first set point may be closer to the second set point than systems 400 in which the HVAC system 412*d* allows in 10% outside air. It will be understood that the first set point may be determined based on other suitable parameters or in any other suitable manner without departing from the scope of this disclosure.

Figure 5:
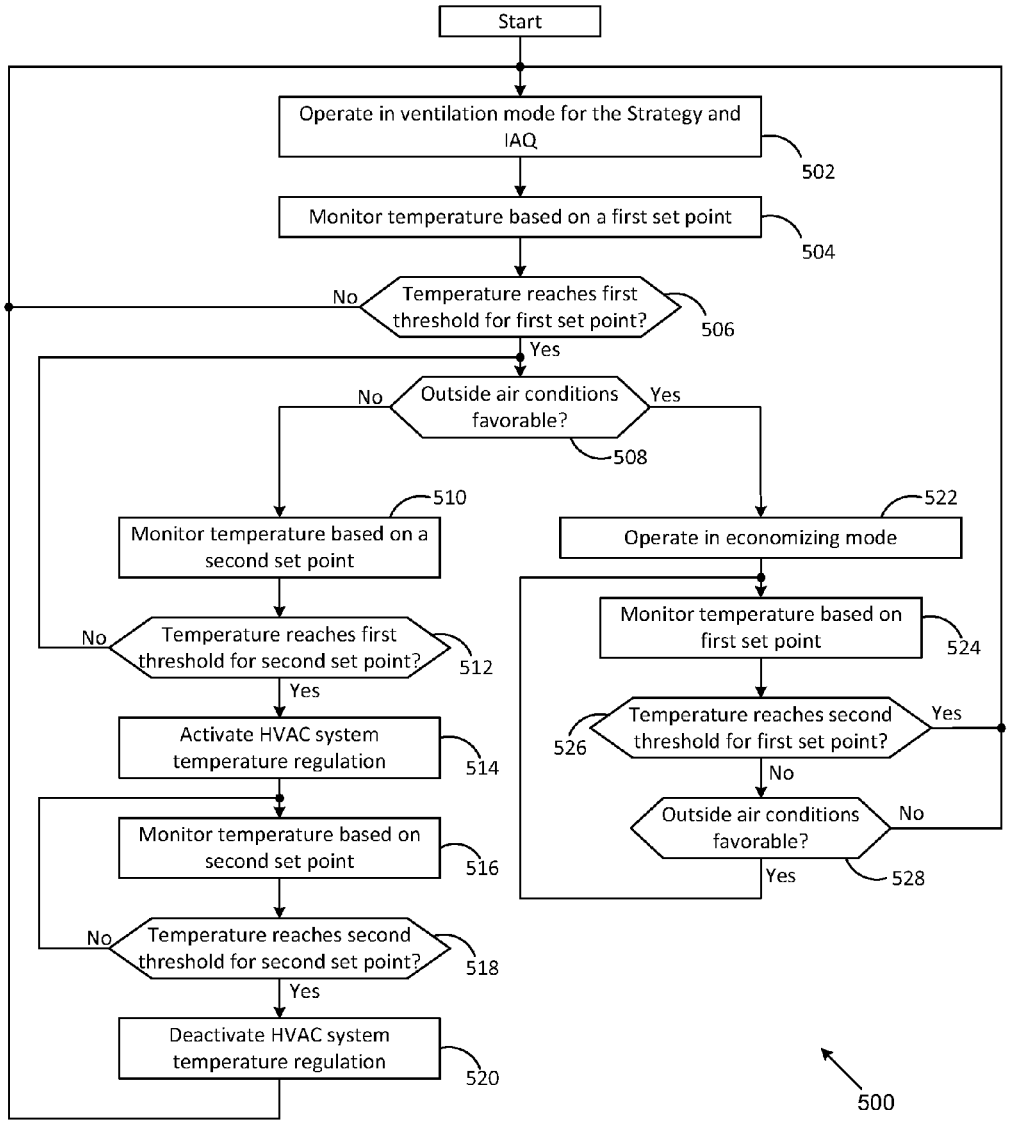
FIG. 5 is a flowchart illustrating a method for improving energy efficiency in an HVAC system in accordance with the present disclosure.

FIG. 5 is a flowchart illustrating a method 500 for improving energy efficiency in an HVAC system in accordance with the present disclosure that may be performed by one or more data processing systems as disclosed herein. The particular embodiment described below refers to the system 400 of FIG. 4. However, it will be understood that the method 500 may be performed by any suitable building system capable of providing demand control ventilation without departing from the scope of this disclosure.

The method 500 begins with the zone controller 410*a* operating in the ventilation mode (step 502). In the ventilation mode, the zone controller 410*a* monitors the contaminant level based on a signal received from the IAQ sensor 412*c* and, if the contaminant level rises too high, the zone controller 410*a* allows outside air into the building to reduce the contaminant level. As described above, the zone controller 410*a* sends a ventilation signal either directly to the ventilation device 414, or indirectly to the ventilation device 414 through the ventilation device controller 412*e*, to allow outside air into the building. For conventional demand control ventilation, the zone controller 410*a* sends a ventilation signal to a damper actuator, which opens a damper to allow outside air into the building. For intelligent demand control ventilation, the zone controller 410*a* sends a ventilation signal to one or more fans (or fan controllers, which control the fans) to turn the fans on, drawing outside air into the building. For intelligent demand control ventilation, the zone controller 410*a* may also send the ventilation signal to a damper actuator to open a damper to allow more outside air into the building. Once the contaminant level decreases to an acceptable level, the zone controller 410*a* sends a ventilation signal that closes the damper and/or turns off the fans to prevent outside air from coming into the building.

While operating in the ventilation mode, the zone controller 410*a* monitors the temperature provided by the temperature sensor 412*b* based on a first set point (step 504). The first set point is determined based on a second set point used for activating the HVAC system 412*d*, as described in more detail above in connection with FIG. 4. It will be understood that the system 400 reacts to each of the set points based on a small range of temperatures. For example, if the set point for activating cooling for the HVAC system 412*d* is 72°, the system 400 activates cooling at a temperature slightly higher than 72°, such as 73°, and continues cooling until the temperature reaches a slightly lower temperature, such as 71.7°. In addition, the system 400 may react to temperatures slightly higher and lower than the economizing set point.

Thus, if the temperature fails to reach a first threshold for the first set point (step 506), the zone controller 410*a* continues to operate in the ventilation mode (step 502) and to monitor the temperature (step 504). For some embodiments, the first threshold may correspond to the same temperature as the first set point. If the temperature reaches the first threshold for the first set point (step 506), the zone controller 410*a* determines whether the outside air conditions provided by the OAC sensor 412*a* in an OAC signal are favorable for free cooling (step 508).

If the outside air conditions are not favorable for free cooling (step 508), the zone controller 410*a* monitors the temperature provided by the temperature sensor 412*b* based on the second set point (step 510). If the temperature fails to reach a first threshold for the second set point (step 512), the zone controller 410*a* may determine whether outside air conditions have become favorable (step 508) while continuing to monitor the temperature based on the second set point as long as the outside air conditions remain unfavorable (step 510). If the temperature reaches the first threshold for the second set point (step 512), the zone controller 410*a* activates temperature regulation by the HVAC system 412*d* by sending an activation signal to the HVAC system 412*d* (step 514).

The zone controller 410*a* then continues to monitor the temperature based on the second set point (step 516). While the temperature has failed to reach a second threshold for the second set point (step 518), the HVAC system 412*d* continues to provide temperature regulation, such as cooling, and the zone controller 410*a* continues to monitor the temperature (step 516). When the temperature reaches the second threshold for the second set point (step 518), the zone controller 410*a* deactivates temperature regulation by the HVAC system 412*d* by sending a deactivation signal to the HVAC system 412*d* (step 520), after which the zone controller 410*a* continues to operate in the ventilation mode (step 502) and returns to monitoring the temperature based on the first set point (step 504).

If the outside air conditions are favorable for free cooling when the temperature reaches the first threshold for the first set point (step 508), the zone controller 410*a* switches to operating in the economizing mode (step 522). In the economizing mode, the zone controller 410*a* sends a ventilation signal either directly to the ventilation device 414, or indirectly to the ventilation device 414 through the ventilation device controller 412*e*, to allow outside air into the building. For conventional demand control ventilation, the zone controller 410*a* sends a ventilation signal to a damper actuator, which opens a damper to allow outside air into the building. For intelligent demand control ventilation, the zone controller 410*a* sends a ventilation signal to one or more fans (or fan controllers, which control the fans) to turn the fans on, drawing outside air into the building. For intelligent demand control ventilation, the zone controller 410*a* may also send the ventilation signal to a damper actuator to open a damper to allow more outside air into the building.

The zone controller 410*a* monitors the temperature provided by the temperature sensor 412*b* based on the first set point (step 524). If the temperature fails to reach a second threshold for the first set point (step 526), the zone controller 410*a* continues to monitor the outside air conditions to ensure that they remain favorable (step 528). If the outside air conditions remain favorable (step 528), the zone controller 410*a* continues to monitor the temperature (step 524).

If the temperature reaches the second threshold for the first set point (step 526) or if the outside air conditions become unfavorable (step 528), the zone controller 410*a* switches back to operating in the ventilation mode and sends a ventilation signal that closes the damper and/or turns off the fans to prevent outside air from coming into the building until contaminant levels rise too high (step 502).

In this way, a configurable set point may be provided for an economizing mode that is different from a set point selected for cooling or heating. This allows the economizing mode, when outside air conditions are favorable, to preempt the ventilation mode before the HVAC system 412*d* is activated. Implementing a different set point for determining when to switch to the economizing mode may significantly delay the time until the HVAC system 412*d* is activated. In some circumstances, implementing a different set point may result in the HVAC system 412*d* not being activated at all. This may result in a substantial improvement in energy efficiency for the HVAC portion of the system 400.

Those of skill in the art will recognize that, unless specifically indicated or required by the sequence of operations, certain steps in the processes described above may be omitted, combined, performed concurrently or sequentially, or performed in a different order. Processes and elements of different exemplary embodiments above can be combined within the scope of this disclosure.

Those skilled in the art will recognize that, for simplicity and clarity, the full structure and operation of all data processing systems suitable for use with the present disclosure is not being depicted or described herein. Instead, only so much of a data processing system as is unique to the present disclosure or necessary for an understanding of the present disclosure is depicted and described. The remainder of the construction and operation of the data processing system 100 may conform to any of the various current implementations and practices known in the art.

It is important to note that while the disclosure includes a description in the context of a fully functional system, those skilled in the art will appreciate that at least portions of the mechanism of the present disclosure are capable of being distributed in the form of instructions contained within a machine-usable, computer-usable, or computer-readable medium in any of a variety of forms, and that the present disclosure applies equally regardless of the particular type of instruction or signal bearing medium or storage medium utilized to actually carry out the distribution. Examples of machine usable/readable or computer usable/readable media include: nonvolatile, hard-coded type media such as read-only memories (ROMs) or electrically erasable programmable read-only memories (EEPROMs), and user-recordable type media such as floppy disks, hard disk drives and compact disc read-only memories (CD-ROMs) or digital versatile discs (DVDs).

While this disclosure has described certain embodiments and generally associated methods, alterations and permutations of these embodiments and methods will be apparent to those skilled in the art. Accordingly, the examples of various embodiments described above do not define or constrain this disclosure. Other changes, substitutions, and alterations are also possible without departing from the spirit and scope of this disclosure, as defined by the following claims.

What is claimed is:

1. A method performed by a zone controller for a zone of a building for improving energy efficiency in a heating, ventilation, and air conditioning (HVAC) system, comprising:

operating in a ventilation mode;

monitoring a temperature of the zone;

monitoring outside air conditions for the building;

determining whether to switch from the ventilation mode to an economizing mode based on a first set point for the temperature of the zone and based on the outside air conditions, wherein the first set point is determined based on a second set point for the temperature different from the first set point; and determining whether to activate the HVAC system based on the temperature reaching the second set point when the outside air conditions are not favorable as compared to the temperature of the zone.

2. The method of claim 1, further comprising determining the first set point by modifying the second set point by a predetermined amount.

3. The method of claim 1, wherein the HVAC system comprises a fixed-damper HVAC system, the method further comprising determining the first set point based on a percentage of outside air allowed in by the fixed-damper HVAC system.

4. The method of claim 1, further comprising:

monitoring a contaminant level for at least part of the building while operating in the ventilation mode; and allowing outside air into the building while operating in the economizing mode or when the contaminant level rises to a predetermined threshold while operating in the ventilation mode.

5. The method of claim 4, wherein allowing outside air into the building comprises sending a ventilation signal to a damper actuator that causes the damper actuator to open a damper on the HVAC system.

6. The method of claim 4, wherein allowing outside air into the building comprises sending a ventilation signal that turns on at least one fan.

7. A zone controller for a zone of a building, comprising:

a memory configured to store a subsystem application; and a processor coupled to the memory, wherein the processor is configured, based on the subsystem application, (i) to operate in one of a ventilation mode and an economizing mode, (ii) to monitor a temperature of the zone, (iii) to monitor outside air conditions for the building, (iv) to switch from the ventilation mode to the economizing mode based on a first set point for the temperature of the zone and based on the outside air conditions, wherein the first set point is determined based on a second set point for the temperature different from the first set point, and (v) to activate a heating, ventilation, and air conditioning (HVAC) unit based on the temperature reaching the second set point when the outside air conditions are not favorable as compared to the temperature of the zone.

8. The zone controller of claim 7, wherein the processor is further configured to determine the first set point by modifying the second set point by a predetermined amount.

9. The zone controller of claim 7, wherein the HVAC system comprises a fixed-damper HVAC system, and wherein the processor is further configured to determine the first set point based on a percentage of outside air allowed in by the fixed-damper HVAC system.

10. The zone controller of claim 7, wherein the processor is further configured (i) to monitor a contaminant level for at least part of the building while operating in the ventilation mode and (ii) to allow outside air into the building while operating in the economizing mode or when the contaminant level rises to a predetermined threshold while operating in the ventilation mode.

11. The zone controller of claim 10, wherein the zone controller is coupled to a ventilation device controller, wherein the ventilation device controller is coupled to a ventilation device, wherein the processor is configured to allow outside air into the building by sending a ventilation signal to the ventilation device controller, and wherein based on the ventilation signal, the ventilation device controller is configured to cause the ventilation device to bring outside air into the building.

12. The zone controller of claim 11, wherein the ventilation device controller comprises a damper actuator and the ventilation device comprises a damper on the HVAC system, and wherein the ventilation signal causes the damper actuator to open the damper.

13. The zone controller of claim 10, wherein the zone controller is coupled to a ventilation device, wherein the processor is configured to allow outside air into the building by sending a ventilation signal to the ventilation device, and wherein based on the ventilation signal, the ventilation device is configured to bring outside air into the building.

14. The zone controller of claim 13, wherein the ventilation device comprises a plurality of fans, and wherein the ventilation signal turns on at least a subset of the fans.

15. A non-transitory computer-readable medium encoded with executable instructions that, when executed, cause one or more data processing systems in a zone controller for a zone of a building to:

operate in one of a ventilation mode and an economizing mode;

monitor a temperature of the zone;

monitor outside air conditions for the building;

determine whether to switch from the ventilation mode to the economizing mode based on a first set point for the temperature of the zone and based on the outside air conditions, wherein the first set point is determined based on a second set point for the temperature different from the first set point; and activate a heating, ventilation, and air conditioning (HVAC) system based on the temperature reaching the second set point when the outside air conditions are not favorable as compared to the temperature of the zone.

16. The non-transitory computer-readable medium of claim 15, wherein the computer-readable medium is further encoded with executable instructions that, when executed, cause one or more data processing systems to determine the first set point by modifying the second set point by a predetermined amount.

17. The non-transitory computer-readable medium of claim 15, wherein the HVAC system comprises a fixed-damper HVAC system, and wherein the computer-readable medium is further encoded with executable instructions that, when executed, cause one or more data processing systems to determine the first set point based on a percentage of outside air allowed in by the fixed-damper HVAC system.

18. The non-transitory computer-readable medium of claim 15, wherein the computer-readable medium is further encoded with executable instructions that, when executed, cause one or more data processing systems to:

monitor a contaminant level for at least part of the building while operating in the ventilation mode; and allow outside air into the building while operating in the economizing mode or when the contaminant level rises to a predetermined threshold while operating in the ventilation mode.

19. The non-transitory computer-readable medium of claim 18, wherein the computer-readable medium is further encoded with executable instructions that, when executed, cause one or more data processing systems to allow outside air into the building by sending a ventilation signal to a damper actuator that causes the damper actuator to open a damper on the HVAC system.

20. The non-transitory computer-readable medium of claim 18, wherein the computer-readable medium is further encoded with executable instructions that, when executed, cause one or more data processing systems to allow outside air into the building by sending a ventilation signal that turns on at least one fan.

* * * * *